US005813829A

United States Patent [19]

Mazzotta

[11] Patent Number: 5,813,829

[45] Date of Patent: Sep. 29, 1998

[54] DISENGAGEABLE MANUAL DRIVE FOR ROTATING A TURBOMACHINE ROTOR

[75] Inventor: Patrice Mazzotta, Vigneux sur Seine, France

[73] Assignee: Societe Nationale d'Etude et de Construction de Moteurs d'Aviation "Snecma" , Paris, France

[21] Appl. No.: 672,915

[22] Filed: Jun. 28, 1996

[30] Foreign Application Priority Data

Jun. 28, 1995 [FR] France ..... 95 07754

[51] Int. Cl.[6] ..... F01D 25/34

[52] U.S. Cl. ..... 415/123; 415/122.1; 415/124; 415/201; 74/625; 464/169

[58] Field of Search ..... 415/118, 122.1, 415/123, 124, 174.2, 201, 230, 231; 464/162, 169, 179, 182; 60/39.091, 39.142; 403/1; 74/625; 192/69, 69.8, 95; 277/5, 8, 9, 11

[56] References Cited

U.S. PATENT DOCUMENTS

| | | | |
|---|---|---|---|
| 3,150,750 | 9/1964 | Georges | 74/625 |
| 3,916,939 | 11/1975 | Gillard | 192/95 |
| 4,437,821 | 3/1984 | Ogawa | 277/9 |
| 4,518,148 | 5/1985 | Renfro . | |
| 4,733,529 | 3/1988 | Nelson et al. | 60/39.091 |
| 4,781,211 | 11/1988 | Cormier . | |
| 5,513,831 | 5/1996 | Seward | 192/95 |

FOREIGN PATENT DOCUMENTS

| | | |
|---|---|---|
| 23 10 200 | 6/1974 | Germany . |
| 31 50 797 | 6/1983 | Germany . |
| 35 21 397 | 10/1986 | Germany . |

*Primary Examiner*—Christopher Verdier
*Attorney, Agent, or Firm*—Oblon, Spivak, McClelland, Maier & Neustadt, P.C.

[57] ABSTRACT

Manual rotation of a turbomachine rotor in order to bring the blades of the rotor one by one in front of an endoscope to check the blades is effected by a shaft which is rotatably connected to the rotor and which may be, for example, a shaft of the auxiliary equipment of the turbomachine, the shaft being manually rotatable by a driving shaft which is mounted in an opening in the casing housing the shaft and which is engageable with the shaft by self-disengaging coupling, a seal being provided between the driving shaft and the casing.

5 Claims, 2 Drawing Sheets

DISENGAGEABLE MANUAL DRIVE FOR ROTATING A TURBOMACHINE ROTOR

BACKGROUND OF THE INVENTION

1. Field of the Invention

The invention relates to a turbomachine, and more particularly to means for manually rotating the rotor of a turbomachine for endoscopic inspection of the blades of the rotor.

2. Summary of the Prior Art

Turbomachines, and in particular aircraft turboshaft engines, have to undergo regular inspections and checks. Some inspections are carried out using endoscopes which are inserted into the turboshaft engine through closable openings provided for the purpose, thus enabling components which are not visible from outside to be inspected without partly dismantling the engine. To inspect the blades of the rotor, an endoscope is introduced into the gas flow path via closable openings in the casing of the engine, and each blade is brought in turn in front of the endoscope by rotating the rotor step by step. This stepwise rotation of the rotor is usually carried out by manually turning a rotary member mechanically connected to the rotor.

Usually, such manual rotation is imparted to one of the pinions of the auxiliary equipment box, thereby rotating the high pressure rotor by means of the mechanical transmission rotatably linking the rotor with the pinions of the equipment box. Access is gained to the pinion by means of a closable opening in the casing of the equipment box. This opening is generally adjacent the end of the pinion shaft, and the pinion is turned with the aid of a handwheel or a standard ratchet handle which is placed into engagement with a non-circular bearing, e.g. square, provided at the end of the shaft of the pinion to be driven.

The opening is usually closed by a cover which has to be removed, and which is replaced when the work is done. Sometimes, an item of equipment may have to be removed to gain access to the shaft transmitting movement to said item.

When access to the pinion is gained by removing a cover, it can happen that the operator carrying out the inspection forgets to replace the cover. This will allow leakage of oil through the unclosed opening, leading to the rapid loss of the oil reserve of the turbomachine during its operation.

Such an oversight is unlikely when it is necessary to remove an item of equipment, but the need to remove and then replace equipment to carry out an endoscopic inspection of the rotor blades takes time, thereby prolonging the operation and increasing maintenance costs, and hence constitutes a drawback.

It is a possibility to extend the pinion shaft through the casing wall and to provide a seal between the shaft and the casing, thereby enabling the shaft to be driven from the outside without dismantling any equipment. However, there are two drawbacks to such an arrangement:

1) Because of the working temperature and the degree of reliability expected, particularly in the case of aircraft turboshaft engines, a seal of the ceramic or carbon ring type would have to be used, which would be costly; and
2) although such a seal is reliable, its use would nevertheless introduce an additional breakdown possibility, whereas it is a normal requirement of turbomachines that they work for long periods without intervention.

SUMMARY OF THE INVENTION

With the aim of avoiding these drawbacks, according to the invention a turbomachine including a rotor, a shaft connected to the rotor to rotate therewith, and a casing surrounding the shaft and having a wall provided with an opening permitting access to said shaft, is provided with manually operable drive means for rotating the rotor comprising:

a removable holder mounted in said opening;

a driving shaft held in said removable holder;

disengageable coupling means for rotatably coupling said driving shaft to said shaft;

means for automatically disengaging said coupling means to disengage said driving shaft from said shaft; and sealing means for effecting at least a static seal between said driving shaft and said wall of said casing at least when said driving shaft is disengaged from said shaft.

It will be appreciated that such an arrangement enables the rotor to be turned manually by engaging the coupling and turning the driving shaft, without opening the casing.

The provision of means for automatically disengaging the coupling ensures that the driving shaft will remain stationary during operation of the turbomachine, and the static sealing means associated with the driving shaft and the casing prevents, in a reliable and inexpensive manner, any oil loss through the opening in the casing wall.

The arrangement is inexpensive and may replace the cover in existing machines without any modification of the casing, which makes it possible, at little expense, to apply the invention retroactively to turbomachines already in service.

Preferably, the driving shaft is coaxial with the shaft which is to be driven, and is movable axially to engage and disengage the coupling between them. This simplifies the arrangement, and the means for automatically disengaging the coupling may simply comprise a spring which urges the driving shaft axially away from the shaft.

Further preferred features and advantages of the invention will become apparent from the following description of a preferred embodiment and with reference to the attached drawings.

DESCRIPTION OF THE PREFERRED EMBODIMENT

Figure 1:
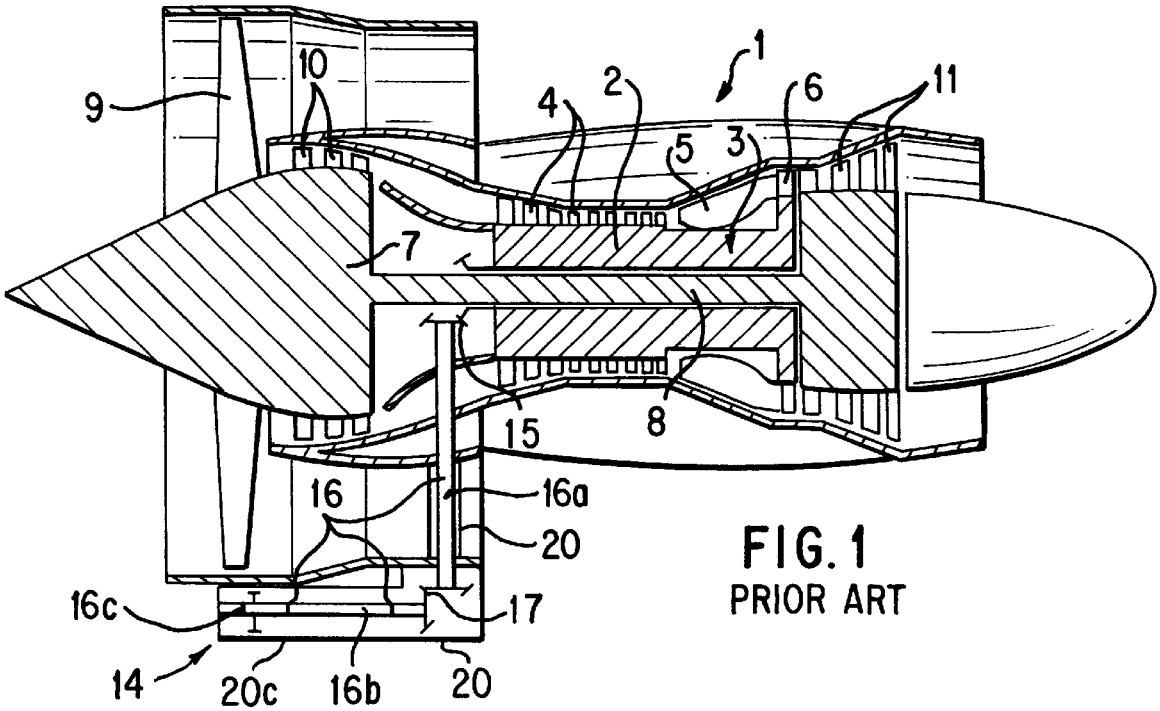
FIG. 1 PRIOR ART
FIG. 1 is a simplified cross-sectional view of a turbomachine of the twin-spool turbofan bypass type showing the kinematic chain from rotor to gearbox.

The turbomachine 1 illustrated in FIG. 1 is a twin-spool turbofan engine of a type which is well known for propelling transport aircraft. Accordingly, only those parts of the turbomachine 1 which are related to the invention will be described. The high pressure rotor 2 of the turbomachine has a shaft 3 which is integral with several stages of blades 4 of a high pressure compressor upstream of a combustion chamber 5, and which is integral with one or more stages of blades 6 of a high pressure turbine immediately downstream of the combustion chamber 5. The low pressure rotor 7 comprises a shaft 8 which is coaxial with and extends through the shaft 3, the shaft 8 being integral at its upstream end with a stage of fan blades 9 and several stages of blades 10 of a low pressure compressor, and being integral at its downstream end with one or more stages of blades 11 of a low pressure turbine. A kinematic drive chain extends from the shaft 3 of the high pressure rotor to the auxiliary equipment holder 14 and includes a succession of shafts 16 operating inside casings 20 and rotatably connected directly or indirectly to the rotor 2. Thus, in FIG. 1 there are shown, in succession, a first twin-bevel gear 15 driving through a 90° angle, a first transmission shaft 16*a* perpendicular to the shaft 3, a second twin-bevel gear 17 driving through a 90° angle, and a second transmission shaft 16*b* parallel to the shaft 3 and rotatably driving one of the shafts and pinions 16*c* in the equipment holder 14. Various items of equipment, such as a starter and oil and fuel pumps, are driven by the shafts and pinions 16 of the equipment holder 14. Because of the difficult operating conditions, the rotating components 16 of the kinematic chain operate inside sealed casings 20 and are lubricated by oil or oil mists.

The low pressure rotor 7 is directly accessible from the outside of the engine both at the front and at the rear, and stepwise rotation of the low pressure rotor can be effected directly by hand. In contrast, the high pressure rotor 2 is not directly accessible from outside the engine, and stepwise rotation of the rotor 2 is achieved by manually driving one of the shafts 16.

Figure 2:
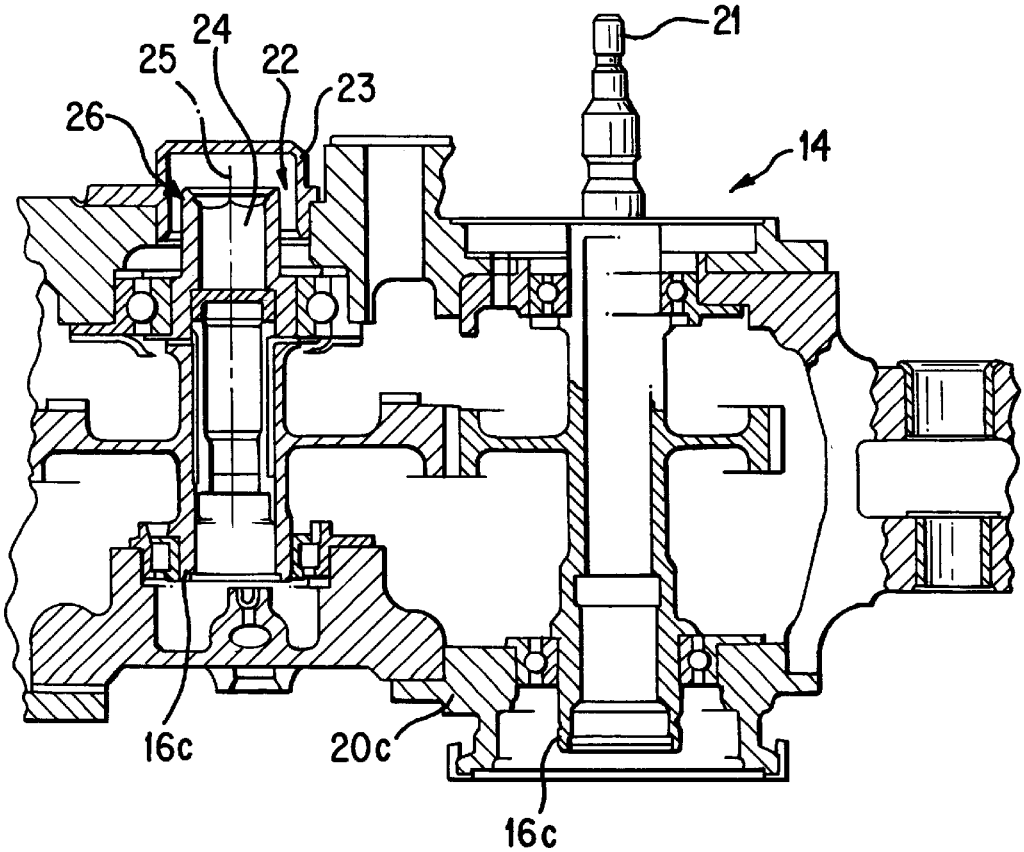
FIG. 2 PRIOR ART
FIG. 2 is a sectional view illustrating one known arrangement for manually rotating the rotor of a turbomachine.

Referring now to FIG. 2, the equipment holder 14 includes a casing 20*c* surrounding and supporting a plurality of shafts and pinions 16*c* in mutual engagement. The shaft 16*b* in FIG. 1 transmits its rotation to one of the shafts and pinions 16*c* of the equipment holder 14 by means of a coupling 21 generally of the spline type, and this rotation is transmitted in turn to the other shafts and pinions 16*c*. An opening 22 in the casing 20*c* is provided facing the end of a shaft 16*c* and, in the known arrangement illustrated, is closed by a removable cover 23. A non-circular, for example square, socket 24 is provided in the end 26 of the shaft 16*c* concentric with its geometric axis 25. Thus, in order to turn the high pressure rotor manually step by step to bring each blade 4 or 6 in turn before an endoscope, it is necessary to remove the cover 23, insert the square connector of a handwheel or crank into the square socket 24 and operate the said wheel or crank to turn the shaft 16*c*. If, subsequently, the cover 23 is inadvertently not replaced in position, the oil dispensed inside the casing 20*c* during the running of the turbomachine will escape through the opening 22, which will cause rapid depletion of the oil reservoir of the turbomachine, with consequent damage to, and breakdown of, the turbomachine.

Figure 3:
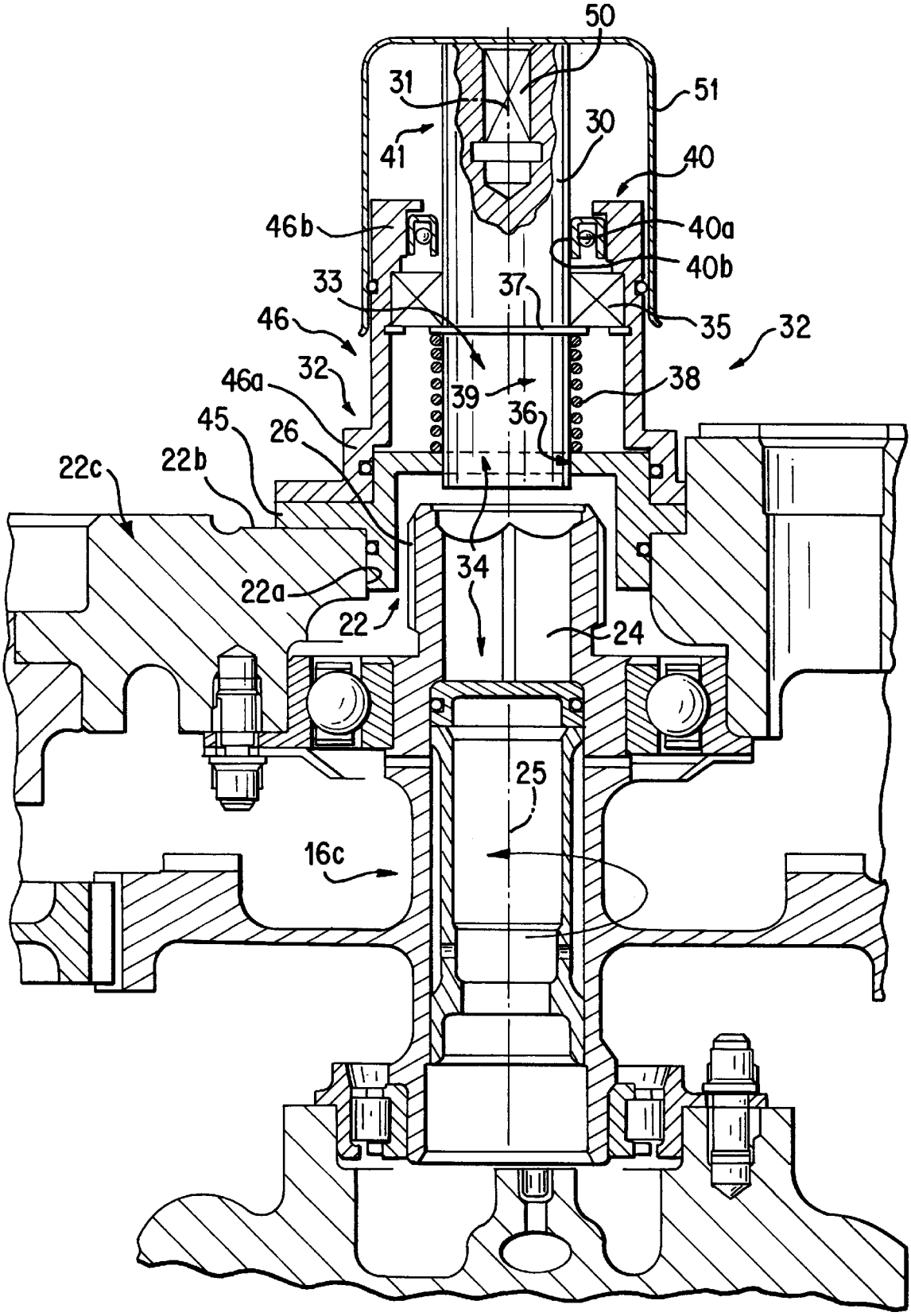
FIG. 3 is a sectional view showing one embodiment of manually operable rotor drive means in accordance with the invention.

With reference now to FIG. 3, the arrangement in accordance with the invention comprises a driving shaft 30 which is held by a holder 32 mounted in the opening 22 so that its geometric axis 31 is aligned with the geometric axis 25 of the shaft 16*c* and the end 33 of the driving shaft 30 faces the end 26 of the shaft 16*c*. The end 33 of the shaft 30 is formed as a male non-circular end having a shape complementary to that of the socket 24 in the end 26 of the shaft 16*c* so that the end 33 can be introduced into this socket by axial movement of the shaft 30 towards the shaft 16*c*. It will be appreciated that the end 33 and the socket 24 constitute a releasable coupling, which will be referenced generally as 34.

Movement of the driving shaft 30 both axially and rotationally is guided by a bearing 35 disposed around the central part of the shaft. This guidance is sufficient when the end 33 is received in the socket 24, that is to say when the coupling 34 is engaged. Preferably, however, the driving shaft 30 will also be guided by a second bearing 36 which, in the embodiment shown, is formed by an aperture in the holder 32, the shaft 30 engaging in this bearing 36 near the end 33 of the shaft.

In its central region the shaft 30 has an external shoulder 37 against which bears one end of a helical compression spring 38 surrounding the shaft 30, the other end of the spring 38 bearing against the holder 32 surrounding the bearing aperture 36. The shoulder 37 may instead by formed by a circlip. The spring 38 urges the shaft 30 axially outwards to the position shown in FIG. 3 in which the shaft 30 is disengaged from the socket 24 of the shaft 16*c*, the spring 38 and the shoulder 37 effectively constituting automatic disengaging means 39 for the coupling 34. In its disengaged position, the shoulder 37 of the driving shaft 30 bears against the bearing 35, and the shoulder 37 thus also performs the function of axially retaining the shaft 30 in the holder 32.

The driving shaft 30 is sealed relative to the casing 20*c* by means 40 which preferably comprises a lip seal 40*a* which is fitted in the holder 32 and bears on a circular peripheral surface 40*b* of the shaft 30. Advantageously, the surface 40*b* will be on a portion of the shaft which tapers slightly and conically towards the end 41 of the shaft 30 remote from the casing 20*c*, the reducing diameter of the surface 40*b* towards the end 41 being sufficient for the contact between the seal 40*a* and the surface 40*b* to become less tight or even nonexistent when the driving shaft 30 is moved axially towards the shaft 16*c* to engage the coupling 34 for manual rotation of the rotor.

In the preferred embodiment shown, the seal 40*a* is an annular graphite-charged teflon seal of U-shaped cross-section, the mouth of which faces towards the inside of the casing in a direction parallel to the geometric axis 31 of the shaft 30 so that the wings of the U bear one against the surface 40*b* of the shaft 30 and the other against the wall of a recess in the holder 32 in which the seal 40*a* is housed. Generally, the U-shaped seal 40*a* will include an annular spring (not referenced) which acts on the inner wing of the U to increase the pressure exerted by the seal 40*a* on the surface 40*b*. Such a seal 40a is available, for example, under the trade name BALSEAL.

It will be appreciated that during operation of the turbomachine, the spring 38 holds the driving shaft 30 in its disengaged position. Consequently, the shaft 30 is not driven by the shaft 16*c* and accordingly remains stationary. In this state the sealing means 40 operates in a static manner, which imparts great reliability to the seal in spite of the severe environmental conditions experienced and enables relatively inexpensive sealing means to be used.

Using a lip seal 40*a* with an inwardly facing lip is the preferred solution because pressure builds up inside the casing 20*c* during the operation of the turbomachine, and this pressure acts to apply the said lip against the surface 40*b*, thus improving the sealing efficiency and the reliability of the seal during operation. Conversely, when the machine is stopped, the pressure in the casing 20*c* subsides and the force pressing the lip of the seal 40*a* against the surface 40*b* is reduced, thus reducing the friction of the sealing means 40 and facilitating operation of the shaft 30.

The reliability of the seal 40*a* is further improved by the conicity of the surface 40*b*. When the driving shaft 30 is operated to rotate the shaft 16*c*, the shaft 30 has first to be pushed into the casing to couple it with the shaft 16*c*. This shifts the shaft 30 axially relative to the seal 40*a* so that the latter becomes located around the surface 40*b* of the shaft 30 towards its end 41, where the cylindrical surface 40*b* has a reduced diameter. As a result, the seal 40*a* then bears only weakly or not at all on the surface 40*b*, and there is no danger that the seal 40*a* could become damaged or worn by rotation of the shaft 30 or the radial bottoming of this shaft 30 resulting from the clearances in the bearings 35 and 36.

As shown, the holder 32 preferably has a base 45 fitting against the wall 22*a* of the opening 22 and against the outer face 22*b* of the casing around the opening 22, and a cylindrical portion 46 attached at one end 46*a* to the base 45. The other end 46*b* of the cylindrical portion 46 is located away from the casing 20*c* and houses the sealing means 40.

The bearing 36 is formed in the base 45, and the bearing 35 is housed in the portion 46, the spring 38 acting between the base 45 and the shoulder 37 of the driving shaft within the portion 46. The base is statically sealed relative to the casing 20*c*, and the cylindrical portion 46 is sealed relative to the base 45, for example by means of ordinary O-ring seals. The cylindrical portion 46 surrounds the central part of the shaft 30, the bearing 35 and the automatic disengaging means 39, thus ensuring the protection of these elements. The holder 32 is fixed to the casing 20*c*, for example by screws, as is the cover in the prior art arrangement.

The outer end 41 of the driving shaft 30 has a square or other non-circular socket 50, centered on its geometric axis 31, for the insertion of a removable member, such as a standard ratchet handle or a handwheel, for rotating the shaft 30. Preferably the end 41 of the shaft 30, which protrudes from the cylindrical portion 46 is protected by a removable cap 51 which is secured to the cylindrical portion 46 and sealed at least against the ingress of dust. This cover 51 will of course be removed when the driving shaft 30 is to be operated.

It will be clear that the present invention does not apply only to the equipment holder 14 of the turbomachine 1, but can be used for any shaft 16 which is rotatably connected to the rotor 2 and is easily accessible from outside through an opening 22 in a casing 20 surrounding the shaft 16.

It will also be clear that the relative arrangement and the method of coupling the shafts 16 and 30 may have alternative constructions without departing from the scope of the invention. For example, if the shafts 16 and 30 remain in alignment, a claw coupling may be used instead of the socket coupling which has been described. If the shafts 16 and 30 are instead situated in a mutually parallel arrangement, or are arranged with their geometric axes 25 and 31 concurrent, a gear coupling between the two may then be used.

Furthermore, the static seal between the shaft 30 and the holder 32 may instead be provided by a high slant conical shoulder on the shaft 30 which, in the disengaged position, is received in a recess of complementary shape in the holder 32, the conical shoulder being provided in its surface with a groove housing an O-ring seal which ensures perfect sealing with the conical recess without rubbing against the latter during disengagement.

I claim:

1. In a turbomachine including a rotor, a shaft connected to said rotor to rotate therewith, a casing housing said shaft, and a non-circular socket being provided in the end of said shaft, said casing having a wall provided with an opening, said opening being provided facing the end of said shaft thereby permitting access to said shaft, and a manually operable drive means for rotating said rotor, said manually operable drive means comprising:

a removable holder mounted in said opening;

a driving shaft held in said removable holder; said driving shaft being axially movable, said driving shaft having an end formed as a male non-circular end having a shape complementary to that of the socket in the end of the shaft, so that the end of said driving shaft can be introduced into said socket by axial movement of said drive shaft towards said shaft, said driving shaft having an outer end, said outer end having a non-circular socket for the insertion of a removable member for rotating by hand said driving shaft;

means for automatically disengaging said driving shaft from said shaft; and sealing means for effecting at least a static seal between said driving shaft and said holder at least when said driving shaft is disengaged from said shaft.

2. A manually operable drive means according to claim 1, wherein said means for automatically disengaging said driving shaft from said shaft includes a spring which urges said driving shaft axially towards a position in which it is disengaged from said shaft.

3. A manually operable drive means according to claim 2, wherein said driving shaft has a portion which tapers conically towards the end of said driving shaft remote from said driving shaft, said portion having a circular cross-section, and said sealing means includes a seal which is retained by said removable holder and which surrounds said tapering portion of said driving shaft and bears sealingly on the surface thereof when said driving shaft is in said position wherein it is disengaged from said shaft, said sealing contact between said seal and said surface being reduced or eliminated when said driving shaft is moved axially to engage said coupling means for manual rotation of the rotor.

4. A manually operable drive means according to claim 1, wherein said turbomachine further comprises an auxiliary equipment casing, and wherein said casing housing said shaft is said casing for said auxiliary equipment of said turbomachine.

5. A manually operable drive means according to claim 1, wherein the end of said driving shaft remote from said shaft is located outside the casing, and a detachable dust protection cap is statically sealed to said removable holder to cover said end of said driving shaft.

* * * * *